US005820278A

United States Patent [19]

Uggetti

[11] Patent Number: 5,820,278

[45] Date of Patent: Oct. 13, 1998

[54] PRINTING RIBBON FEEDING DEVICE

[75] Inventor: Sergio Uggetti, Ivrea, Italy

[73] Assignee: Olivetti Lexikon S.p.A., Italy

[21] Appl. No.: 750,117

[22] PCT Filed: May 22, 1995

[86] PCT No.: PCT/IT95/00086

§ 371 Date: Nov. 26, 1996

§ 102(e) Date: Nov. 26, 1996

[87] PCT Pub. No.: WO95/32870

PCT Pub. Date: Oct. 7, 1995

[30] Foreign Application Priority Data

May 26, 1994 [IT] Italy ..... TO94A0429

[51] Int. Cl.[6] ..... B41J 33/28; B41J 33/14

[52] U.S. Cl. ..... 400/223; 400/196.1

[58] Field of Search ..... 400/223, 235.1, 400/225, 227, 227.1, 227.2, 196.1, 194

[56] References Cited

U.S. PATENT DOCUMENTS

| | | | |
|---|---|---|---|
| 4,091,914 | 5/1978 | Stipanuk | 400/196.1 |
| 4,343,556 | 8/1982 | Kobayashi | 400/235.1 |
| 5,030,022 | 7/1991 | Casey | 400/194 |
| 5,083,878 | 1/1992 | Surti . | |
| 5,114,254 | 5/1992 | Sato et al. | 400/227.2 |
| 5,354,138 | 10/1994 | Daggs | 400/223 |

FOREIGN PATENT DOCUMENTS

| | | |
|---|---|---|
| 0 313 245 | 4/1989 | European Pat. Off. . |
| 0 601 685 | 6/1994 | European Pat. Off. . |

*Primary Examiner*—Edgar S. Burr
*Assistant Examiner*—Amanda B. Sandusky
*Attorney, Agent, or Firm*—Banner & Witcoff, Ltd.

[57] ABSTRACT

This invention relates to a device (11) for the feeding of a printing ribbon (12), comprising a train of three gears having a first gear (13) arranged centrally in the train and meshed with the second (14) and with the third gear (20). The gears (13, 14, 20) are provided for being made to rotate by a driving shaft (17) integral with the second gear (14). In order to increase the feeding force for the printing ribbon (12), the latter is interposed both between the first (13) and second gear (14), and between the first (13) and the third gear (20), in such a way as to follow the profile of the meshed teeth of the gears (13, 14, and 20) and consequently to assume a form with windings. The diameter of the third gear (20) is greater than the diameter of the second gear (14), so that in an intermediate portion (27) between the third gear (20) and the second gear (14) the ribbon (12) is constantly tight.

1 Claim, 2 Drawing Sheets

PRINTING RIBBON FEEDING DEVICE

CROSS-REFERENCE TO RELATED APPLICATIONS

This application is a§ 371 of PCT/IT95/00086 filed on May 22,1995.

FIELD OF THE INVENTION

The present invention relates to a device for feeding a printing ribbon, comprising a pair of gears formed by a first gear and a second gear mutually meshed, wherein the printing ribbon is interposed between the engaged teeth of said pair of gears, so as to assume a first configuration having a corresponding first plurality of windings which follow the profile of the engaged teeth of the pair of gears.

BACKGROUND OF THE INVENTION

From the European Patent Application No. 313 245, a device of this type is known, which is mounted within a cartridge and which is particularly suitable to allow the printing ribbon to advance towards a magazine, within which the same ribbon is randomly arranged in the form of turns. This device is not capable, in all the conditions, of supplying the printing ribbon with a constant and sufficient traction force, necessary to allow the ribbon to advance in a regular and uniform way, for overcoming all the frictions that the same ribbon meets in its path. Consequently in this device the ribbon may slide with respect to the ribbon driving gears. This inconvenience may mainly happen in the so-called high capacity cartridges, in which either the printing ribbon length to draw, or the friction force opposing to the feeding of the same ribbon, are higher than the usual.

SUMMARY OF THE INVENTION

The technical problem that the present invention aims to solve is that of realizing a printing ribbon feeding device for generating a feeding force which allows the printing ribbon to advance in a regular way and without slidings, even when the feeding force has to assume high values during very critical operating conditions.

This technical problem is solved by the feeding device according to the present invention, comprising a third gear having a diameter equal to the diameter of the first gear and meshed with the latter to form a second pair of gears, wherein the printing ribbon is interposed also between the meshed teeth of the second pair of gears, so as to assume, in addition to the first configuration, a second configuration having a second plurality of windings which correspond to the profile of the engaged teeth of the second pair of gears, the development of the second plurality of windings being greater than the development of the first plurality of windings; resilient means which constantly urge with a predetermined force, one against the other, the gears of at least one of the pair of gears, whereby said printing ribbon is constantly pressed between the gears of such one pair of gears and is fed with a predetermined feeding force proportional to the above predetermined force; and a driving shaft connected with one of the gears for driving the three gears in such a way to advance the ribbon from the first pair to the second pair of gears, whereby the portion of the printing ribbon comprised between the first and second configurations is constantly kept under tension.

BRIEF DESCRIPTION OF THE DRAWINGS

These and other features of the present invention will be clear by the following disclosure, given by way of non-limiting example, with reference to the accompanying drawings, in which.

DETAILED DESCRIPTION OF A PREFERRED EMBODIMENT

Figure 1:
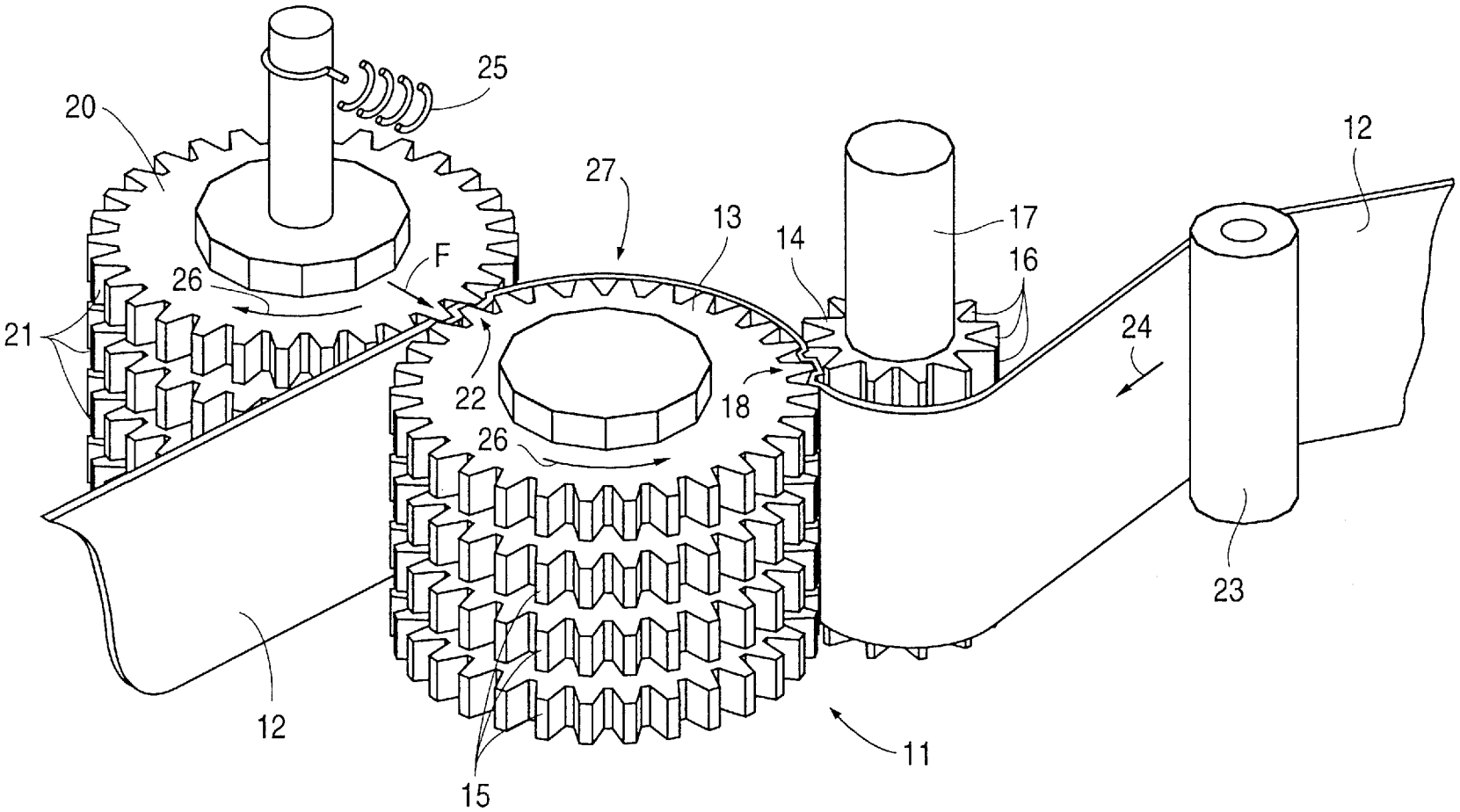
FIG. 1 is a perspective view of a device for the feeding of a printing ribbon according to the invention.
Figure 2:
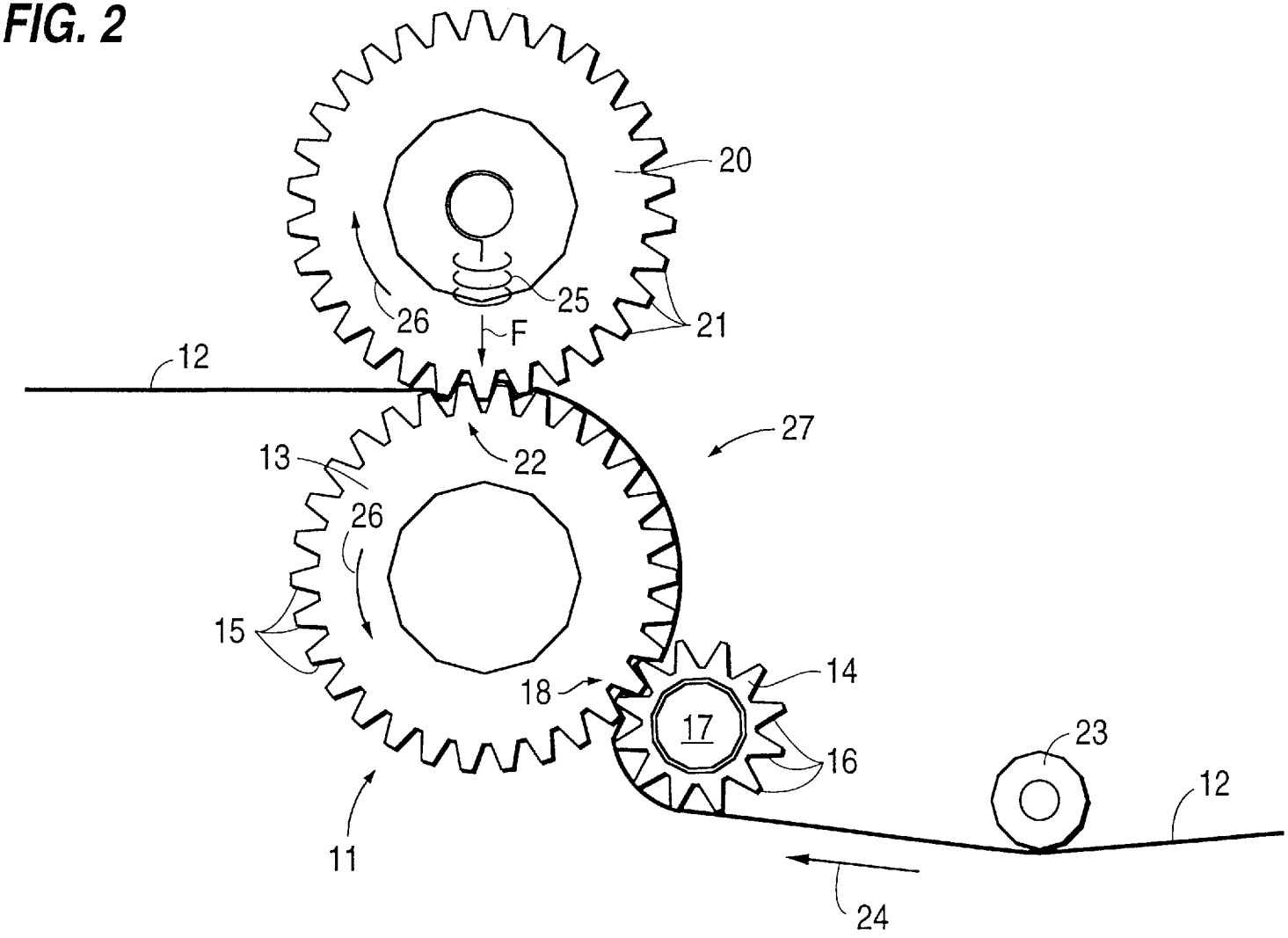
FIG. 2 is a partial plan view of the device of FIG. 1.

Referring to FIGS. 1 and 2 a feeding device 11 for a printing ribbon 12, according to the present invention, comprises a pair of gears 13 and 14 with a plurality of teeth 15, and respectively 16, mutually meshed and a driving shaft 17 fixed to the gear 14 and suitable to receive , in a known manner, the rotary motion from a motor member, for example from a printing carriage, not shown in the drawings.

The printing ribbon 12, of a known type, for example made by inked web, is interposed between the gears 13 and 14 and is obliged, in a portion 18 thereof, to assume a first configuration having windings which follow the form of the teeth 15 and 16 engaged by the gears 13 and 14. A third gear 20 is provided with teeth 21, has a diametrical pitch greater than the diametrical pitch of the gear 14, and is meshed with the gear 13. The ribbon 12 is also interposed between the teeth 15 and 21 of the gears 13 and 20, in such a way as to assume a second configuration with windings 22.

The gears 14 and 20 are arranged angularly staggered with respect to the central gear 13, defining in such a way an intermediate area 27 between the configurations with windings 18 and 22, in which area the ribbon 12 winds round the same gear 13 for a short portion, standing on the ends of the teeth 15. A post 23 is arranged near the driving gear 14 for driving towards it the ribbon 12.

The gears 13 and 14 are preferably mounted with the rotation axis fixed, while the gear 20 is free to move in radial sense with respect to the gear 13. Resilient means, for example formed by a traction spring 25, press the gear 20 against the gear 13 with a predetermined force F and, consequently, the resilient means press the ribbon 12 between the engaged teeth 15 and 21 of the corresponding gears 13 and 20, so obliging the ribbon 12 to follow the path with the windings 22. The traction spring 25 urges always the gear 20 against the gear 13, avoiding oscillations of the axis of the gear 20 with respect to the axis of the gear 13, in such a way to prevent the ribbon 12 to slide with respect to them. The developments of the configurations with windings 18 and 22 are determined by the profile of the teeth 15 and 16 mutually meshed, and respectively by the profile of the teeth 15 and 21 mutually meshed. The diametrical pitch of the gear 20 is greater than the diametrical pitch of the gear 14, and therefore the development of the configuration with windings 22 is greater than the development of the configuration with windings 18.

The functioning of the device according to the present invention is the following.

The driving shaft 17 is made to rotate in the clockwise sense, for permitting the gears 14, 13 and 20 to rotate according to the rotation directions of the arrows 26. The pairs of gears 13–14 and 13–10 allow the ribbon 12 to advance according to the direction indicated by the arrow 24 and permit the ribbon portion, which is in contact with the intermediate area 27 of the gear 13 and is included between the configurations 18 and 22, to be constantly tight, thus preventing the same ribbon 12 to have slackenings or to form undesired bends.

In particular the configuration 22, in consequence of its greater development with respect to the configuration 18, is able both to draw all the ribbon quantity which exits from the configuration 18, and to impart a further driving force to the ribbon 12.

In a preferred embodiment, the gear 14 has twelve teeth while the gears 13 and 20 have each thirty teeth. In this case, assuming that these latter shall be pressed one against the other by an appropriate value of the force F of the spring 25, the device 11 permits to obtain a feeding force of the ribbon 12 higher than 2.000 grams, whilst in the known devices such force is considerably lower.

It is clear that the device of this invention, in the preferred embodiment above disclosed, may be subject to several modifications and/or addition of parts, without departing from the scope of the invention.

I claim:

1. A device (11) for feeding a printing ribbon (12), comprising a first gear (13);

a second gear (14) having a diameter smaller than the diameter of said first gear (13), said first and second gears being mutually meshed to form a first pair of gears (13, 14), a third gear (20) having a diameter equal to the diameter of said first gear (13) and meshed with the latter to form a second pair of gears (13, 20), said printing ribbon (12) being interposed both between the teeth of said first pair of gears (13, 14), so as to assume a first configuration (18) having a first plurality of windings which correspond to the profile of the engaged teeth of said first (13) and second gear (14), and between the teeth of said second pair of gears (13, 20), so as to assume a second configuration (22) having a second plurality of windings which correspond to the profile of the engaged teeth of said first (13) and third gear (20), whereby the development of said second plurality of windings is greater than the development of said first plurality of windings;

resilient means (25) which constantly urge with a predetermined force (F), one against the other, the gears of said second pair of gears (13,20), whereby said printing ribbon (12) is constantly pressed between the gears of said second pair of gears and is fed with a predetermined feeding force proportional to said predetermined force (F); and a driving shaft (17) for driving said gears (14, 13, 20) and integral with said second gear (14), so that said second gear (14) is adapted to operate as a driving gear for driving said first gear (13) and, through the latter, said third gear (20), in order to advance the ribbon from said first pair to said second pair of gears, whereby said second gear (14) is provided for driving said first gear (13) at a reduced speed with respect to the speed of said second gear (14), and moreover said second configuration (22) is capable of spreading the windings of said first configuration and of putting under tension the printing ribbon existing from said first configuration (18).

* * * * *